United States Patent [19]

Simon

[11] 4,277,053

[45] Jul. 7, 1981

[54] LIFTING AND HANDLING EQUIPMENT UNIT, ESPECIALLY FOR SHIPSIDE OPERATIONS

[76] Inventor: Francois Simon, Route d'Annecy, 73410 Albens, France

[21] Appl. No.: 947,013

[22] Filed: Sep. 29, 1978

[30] Foreign Application Priority Data

Dec. 20, 1977 [FR] France ..... 77 29835

[51] Int. Cl.[3] ..... B66D 1/48

[52] U.S. Cl. ..... 254/326; 414/138; 254/337

[58] Field of Search ..... 254/401–404, 254/409–412, 900, 281, 284, 285, 326, 337, 336, 335; 414/137–139; 212/146

[56] References Cited

U.S. PATENT DOCUMENTS

| | | | |
|---|---|---|---|
| 1,968,636 | 7/1934 | Dickhaut | 254/172 X |
| 2,852,936 | 9/1958 | Broussard | 254/172 X |
| 2,948,512 | 8/1960 | Crenshaw, Jr. | 254/337 |
| 2,973,942 | 3/1961 | Schaper | 254/188 |
| 3,343,810 | 9/1967 | Parnell | 254/172 |
| 3,662,991 | 5/1972 | Lakiza et al. | 254/189 |
| 3,743,249 | 7/1973 | Daalen | 254/172 |
| 3,791,628 | 2/1974 | Burns et al. | 254/337 X |
| 3,804,183 | 4/1974 | Duncan et al. | 254/337 X |
| 3,967,735 | 7/1976 | Payne | 254/409 X |
| 4,179,233 | 12/1979 | Bromell et al. | 254/172 X |

*Primary Examiner*—John M. Jillions
*Attorney, Agent, or Firm*—Peter L. Berger

[57] ABSTRACT

Under the action of relative motion between a hoisting machine support and a load, a movable component such as a pulley-block carried by the hoisting machine is capable of free displacement under gravity between two end positions of abutment when that end of the movable component which is intended to cooperate with the load is stationary with respect to the load, thereby compensating for any variation in distance between the load and that portion of the hoisting machine which carries the movable component. The equipment unit is designed primarily for hoisting operations performed at sea or on wharves.

5 Claims, 20 Drawing Figures

LIFTING AND HANDLING EQUIPMENT UNIT, ESPECIALLY FOR SHIPSIDE OPERATIONS

This invention relates to hoisting and handling equipment, especially for hoisting operations on water areas such as, for example, at sea or on wharves.

The invention is more generally concerned with hoisting and handling appliances which are intended for use when a relative movement and especially a vertical movement or a movement having a vertical component takes place between on the one hand the hoisting machine or its support and, on the other hand the load or the support from which the load is to be lifted or on which the load is to be placed.

This is the case especially in operations performed at sea by reason of essentially vertical or oblique movements which take place when the hoisting machine and/or the load is located on a floating platform, barge, lighter, or ocean vessel of any type.

The essential problem to be solved is that of compensating for the variation in distance between the load and the hoisting machine and more especially between the load and that portion of the machine which carries the hoisting pulley-block or the like in order to prevent jerks, ramming or sweeping of the load or of its support by the pulley-block which carries the lifting hook or the like.

When it is necessary to pick up a load, a simple and purely manual method which is already known and performed by an operator consists in placing the hoisting pulley-block on the load support and in unwinding the cable to a length which is sufficient to absorb the movements of relative withdrawal between the hoisting machine and the load support. The load is attached to the hook and the operator actuates the winch for the hoisting operation by making use of a phase of relative approach between the load support and that portion of the machine which carries the hoisting pulley-block or the like.

This method is attended by major disadvantages. As soon as the pulley-block comes to rest after lowering under no load, the cable is in zero tension when unwinding of this latter has compensated for the action of the swell. There is therefore a potential danger of incorrect delivery of the cable and resultant tangling on the cable drum. Furthermore, there is always the danger of ramming and sweeping as long as the pulley-block is not deposited with a sufficient length of unwound cable. Once the pulley-block has been deposited, it is liable to slip on the support and to strike obstacles. Moreover, the cable or slings which are not under tension are in turn deposited in a random fashion and are thus liable to be damaged, to be tangled or to catch on an obstacle as a result of the alternate pulling action produced by the swell, thus preventing any operation. Furthermore, at the time of lifting, it is very difficult to make full use of the upward displacement since the winches do not have a sufficient winding speed (taking into account the mechanical advantage of the block and tackle system) to wind-in a sufficient length of cable to lift the load during a single phase of relative approach. This often has the effect of ramming and sweeping of the support but this time by the load, which is much more hazardous.

It has been endeavored to employ compensating systems of a pneumatic, hydraulic or electric type but these have proved unsatisfactory by reason of the excessive response times which put them in out-of-phase resonance.

The chief object of the invention is to overcome these disadvantages by providing a system of simple design which is reliable and permits of ready compensation for relative motion.

To this end, the hoisting equipment in accordance with the invention and consisting of hoisting machine, winch and hoisting pulley-block for performing lifting operations between the machine support and the load support which are capable of relative motion essentially comprises movable means carried by the hoisting machine and adapted to move freely under gravity between two end positions under the action of said relative motion when that end portion of said movable means which is intended to cooperate with the load is stationary with respect to this latter in such a manner as to compensate for the variation in distance between the load and that portion of the hoisting machine which carries said movable means, stationary abutment means being provided for at least one of said two positions.

When making use of this type of equipment for picking up a load, the operator brings the hoisting pulley-block into position immediately above the load (preferably in respect of the highest relative position of the load) and the slinger who is stationed on said support takes hold of the pulley-block hook or the slings. At the time of the subsequent relative motion, the movable means move under the combined action of a restoring force and of the retaining effort in order to compensate for this motion by modifying the useful length of the cable.

By way of example, the movable means are constituted by at least one movable return element over which the cable passes.

The movable return element is, for example, a pulley-block which is also suspended from the hoisting head or boom.

The movable means can also be constituted by a heavy component for receiving the free end of the cable, namely the end remote from the winch. By way of example, said component consists of a balance-weight.

The invention will be readily understood from the following description in which reference will be made to the accompanying drawings, wherein.

Figure 1:
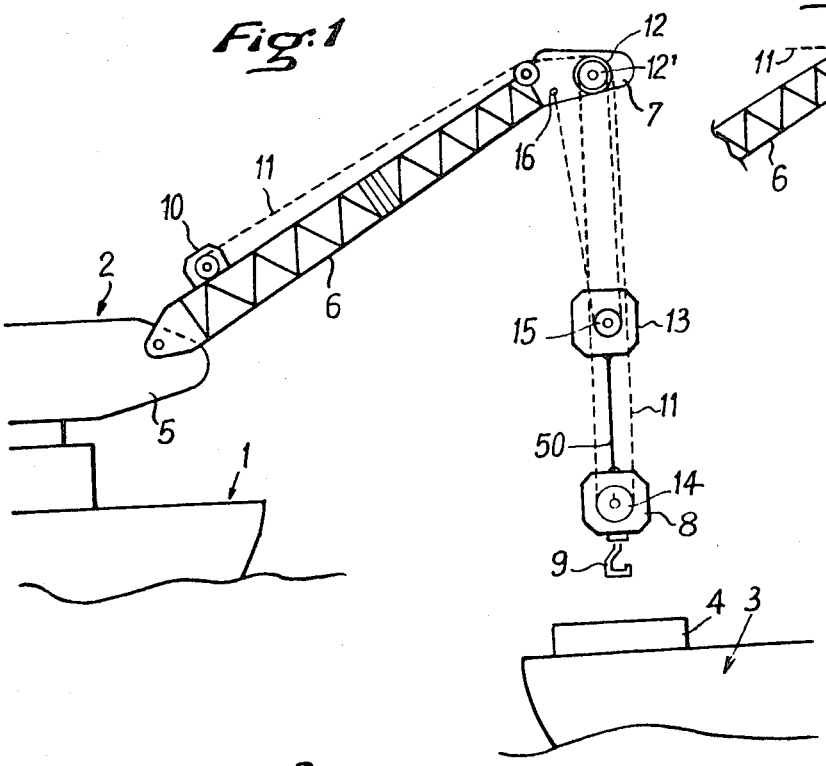
FIG. 1 is a view of an equipment unit in accordance with the invention and comprising two suspended pulley-blocks.

There is shown in FIG. 1 a support 1 on which is mounted a hoisting machine 2 and a support 3 for a load 4 which is to be either deposited on or lifted from this latter. An essentially but not exclusively vertical relative movement takes place between the supports 1 and 3; this is the case, for example, when at least one of the supports 1, 3 is waterborne and subjected to the action of waves.

The hoisting machine 2 which is illustrated by way of example in the form of a crane comprises in known manner a turret 5, a jib or boom 6 and boom head 7, a hoisting pulley-block 8 which carries a lifting hook 9 or the like, a hoisting winch 10 fixed on the boom 6 or on the turret 5 and a lifting cable 11 which extends from the winch 10 through the pulley-block 8 and through at least one head pulley 12 having a fixed axis.

In the embodiment shown in FIG. 1 and in accordance with the invention, a movable return element for the cable 11 is associated with the system described above. Said movable return element is capable of displacement in floating motion under gravity between two end positions under the action of relative motion which takes place between the pulley-block 8 and the boom head 7 when the pulley-block 8 is secured to the support 3 by manual retention or by hooking either onto said support 3 or onto the load 4.

In the example of construction shown in FIG. 1, said movable element is constituted by a pulley-block 13 suspended by means of the cable 11 from the boom head 7. Said cable 11 extends from the winch 10 and passes successively over the pulley 12, over a pulley 14 of the pulley-block 8, over another pulley 12' having a fixed axis on the boom head, and over a pulley 15 of the pulley-block 13; finally, said cable is anchored to the boom 6 at 16. It is readily apparent that the hoisting tackle can consist of a number of strands, in which case the cable passes, after the pulley 15, over at least one other set of pulleys such as those designated by the references 12, 14, 12' and 15 before being anchored to the boom 6 at 16. The pulleys have been shown with different diameters for the sake of enhanced clarity.

The pulley-blocks 8 and 13 are normally located vertically below the boom head 7, the pulley-block 13 being always between the boom head 7 and the pulley-block 8. As described hereinafter, the pulley-block 13 is capable of displacement under the action of gravity between a bottom end position with respect to the pulley-block 8 and a top end position with respect to the pulley-block 8 or to the boom head 7. If no provision is made for connecting means between the pulley-blocks 8 and 13, the bottom end position is the position in which the two pulley-blocks are applied against each other and the top end position is the position in which the pulley-block 13 is abuttingly applied against the boom head 7. If provision is made for connecting means, these latter define at least one of the two end positions. By way of example, there is shown a sling 50 which connects the two pulley-blocks in order to define the top end position of the pulley-block 13.

In accordance with one distinctive feature of the invention, the weight of the pulley-block 13 is of sufficiently high value to bring this latter into the bottom end position when the pulley-block 8 is not subjected to any external action but remains of sufficiently low value to ensure that a moderate action exerted by a slinger in order to pull or retain the pulley-block 8 on the support 3 causes the pulley-block 13 to move upwards with respect to said pulley-block 8.

The operation and utilization of the equipment unit shown in FIG. 1 will now be described, first in a load-lifting operation, then in a load-depositing operation with respect to the support 3.

At the commencement of a load-lifting operation, the pulley-block 13 is located in the bottom position under the action of its own weight and applied against the pulley-block 8 which is under no load. by reason of the fact that the cable 11 is coiled to the maximum and not subjected to any tractive force, the pulley-block 8 is in a top position well above the support 3. The operator actuates the winch in the direction of uncoiling of the cable. The two pulley-blocks 8, 13 move downwards in contact with each other and the pulley-block 13 remains in the relative bottom end position under the action of its own weight. The operator continues the downward motion until the hook 9 or a sling suspended from this latter comes within reach of the slinger who is stationed on the support 3 in respect of that position of the support 3 which is nearest the head 7, whereupon the operator stops the downward travel. This stoppage ensures that the hook 9 cannot subsequently ram or sweep the support 3. During the subsequent downward motion of the support 3 and since the pulley-block 8 is retained by the slinger, said pulley-block moves downwards with respect to the head 7, the necessary active length of cable being supplied by the pulley-block 13 which moves upwards. The effort which is necessary for this upward movement is supplied either by the slinger or by securing to the load 4 or to the support 3. If the support 3 then moves upwards, it is only necessary for the slinger to retain the hook 9 if this latter is not secured. Since the weight of the pulley-block 13 is preponderant, this latter returns downwards whilst the pulley-block 8 moves upwards with the support 3. During these movements, the slinger can engage the load 4 on the hook without either difficulty or danger. In order to lift the load, the operator takes advantage of at least one upward movement of the load in order to wind the cable. The winding speed is such that the pulley-block 13 is in the top end position at the end of one upward movement of the support 3. Any additional winding of the cable or downward motion of the support 3 results in lifting of the load with respect to the support and with respect to the hoisting machine.

In order to deposit the load from the starting condition in which this latter is suspended from the hook and the pulley-block 13 is in the top position, the operator unwinds the cable 11 to a position in which the load arrives exactly at the level of the support 3 in the uppermost position of this latter whilst the pulley-block 13 remains in the top position under the action of said load. The operator takes advantage of the following downward movement of the support 3 in order to unwind the cable once again in such a manner as to ensure that the load 4 moves downwards at a higher speed than the support 3 and is deposited thereon and also in such a manner as to ensure that the pulley-block 13 moves downwards of its own accord in the event that no force is applied by said load. The length of cable to be unwound is of minimum value when the pulley-block 13 is still in the top end position and when the support 3 is in the bottom position. The length of cable to be unwound is of maximum value when the pulley-block 13 is in the bottom end position and when the support 3 is in its top position.

It is apparent from the foregoing description of the operation of the equipment that, at the time of either lifting or depositing of the load, the operator can readily prevent ramming and sweeping of the support 3 by the pulley-block 8 and that the slinger can work both conveniently and without any danger.

Figure 2:
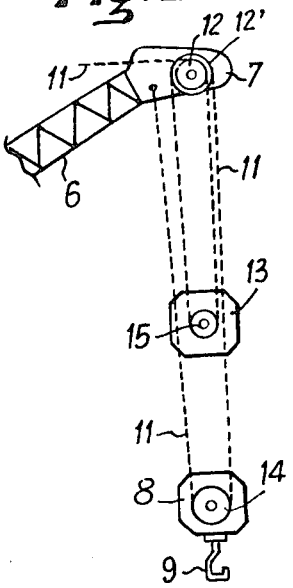
FIGS. 2 to 8 are views which are similar to FIG. 1 and show seven alternative embodiments of an equipment unit which also has two pulley-blocks.

There is shown in FIG. 2 an alternative embodiment which differs from FIG. 1 only in the arrangement of the cable 11. This latter passes successively over the pulley 12 of the head 7, over the pulley 15 of the floating pulley-block 13, over the pulley 12' of the head 7, then over the pulley 14 of the hoisting pulley-block 8 before being attached to the boom 6 at 16. If so required, it would be possible to adopt a pulley-block having a plurality of strands as described with reference to FIG. 1. The operation of this equipment unit is identical with that of the equipment unit shown in FIG. 1.

Figure 3:
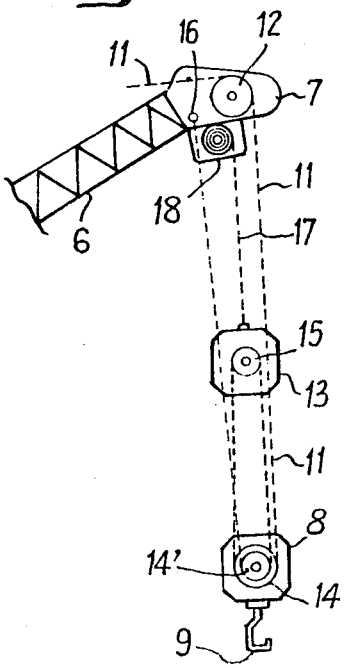

In the embodiment of FIG. 3, the cable 11 passes successively over the pulley 12 of the head 7, over the pulley 14 of the hoisting pulley-block 8 located beneath the floating pulley-block 13, over the pulley 15 of the floating pulley-block 13, over a pulley 14' of the pulley-block 8, and is then anchored to the head 7 at 16. As in the previous instance, the pulley-block can comprise a plurality of strands. The floating pulley-block 13 is suspended from the boom head 7 by means of an auxiliary cable 17 which is urged in the direction of upward motion by a restoring device 18 such as, for example, a spring-loaded winding drum, a clutch-type winch controlled by an auxiliary power supply or any other control system. The restoring force of the device 18 and the weight of the pulley-block 13 are such that, when no external tractive force is applied to the pulley-block 8, the pulley-block 13 is in the top end position or is moving towards this position and that a moderate tractive force applied on the pulley-block 8 is sufficient to unwind the cable 17.

In order to carry out a no-load downward movement towards the load to be lifted, the cable 11 is unwound, the pulley-block 13 remains in the top position and abuttingly applied, for example against the restoring device 18 and the pulley-block 8 moves downwards alone under the restoring action of said device. The downward movement is stopped when the hook 9 or sling reaches the load support 3 in the top position of this latter. The device 18 is then actuated when the slinger exerts a tractive force on the pulley-block 8 at the time of downward motion of the load support. When said support moves upwards again, the tractive force is discontinued and the device 18 lifts the two pulley-blocks at different speeds. The load is also picked up during an upward movement of the load support; winding of the cable 11 and the weight of the load cause the pulley-block 13 to move downwards to its bottom end position in which it is abuttingly applied, for example, against the pulley-block 8.

The load is deposited as follows: at the time of commencement of unwinding of the cable, the pulley-block 13 is at the bottom end position under the action of the load which is suspended from the hook 9. As soon as the load is placed on its support in the top position, the operator unwinds the cable 11 rapidly so as to enable the pulley-block 8 to follow this downward movement and also to enable the pulley-block 13 to move away from the pulley-block 8 if necessary, under the action of the device 18. Once the hook 9 has been released from the load, the operator winds the cable during an upward or downward movement of the load support.

Figure 4:
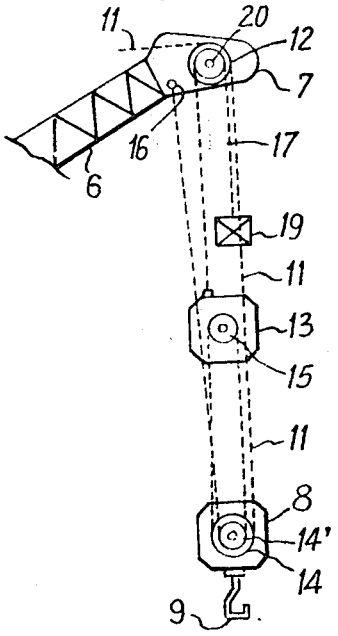

The embodiment of FIG. 4 differs from that of FIG. 3 only in the fact that the winding drum 18 is replaced by a balance-weight 19 whilst the cable 17 from which the floating pulley-block 13 is suspended passes over a head pulley 20. The weight of the balance-weight 17 is just sufficient to overcome the weight of the pulley-block 13 and friction forces.

Figure 5:
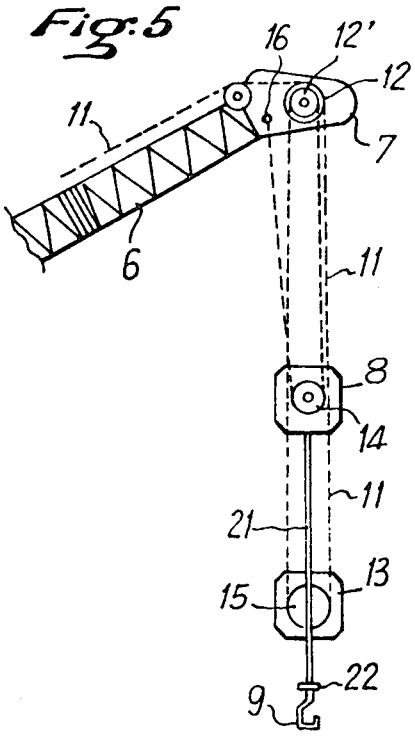

In the embodiment shown in FIG. 5, the hoisting pulley-block 8 is located above the floating pulley-block 13. The hook 9 is located beneath the pulley-block 13 and connected to the pulley-block 8 by means of at least one rod, chain or cable 21 or any other flexible or rigid connecting means which passes through the pulley-block 13. The cable 11 passes successively over the head pulley 12, over the pulley 15 of the pulley-block 13, over the head pulley 12', over the pulley 14 of the pulley-block 8 and is then anchored at 16 to the head 7 of the boom 6. Prior to anchoring, the cable 11 can again be passed at least once over another set of pulleys. The top end position of the pulley-block 13 is that in which the two pulley-blocks are abuttingly applied against each other and the bottom position is that in which the pulley-block 13 is applied against an abutment shoulder 22 which forms part of the hook 9. If necessary, a jack or any other coupling means can define one of these two end positions as described hereinafter.

The weight of the pulley-block 13 is such that this latter is in the bottom end position when the pulley-block 8 and the hook 9 are not subjected to any external action and that a moderate retaining action on the pulley-block 8 is sufficient to cause the pulley-block 13 to move upwards. As can readily be understood, the length of the coupling 21 is compatible with the amplitude of the relative movement to be compensated.

The operation of the equipment unit shown in FIG. 5 is similar to that of the unit shown in FIG. 1.

Figure 6:
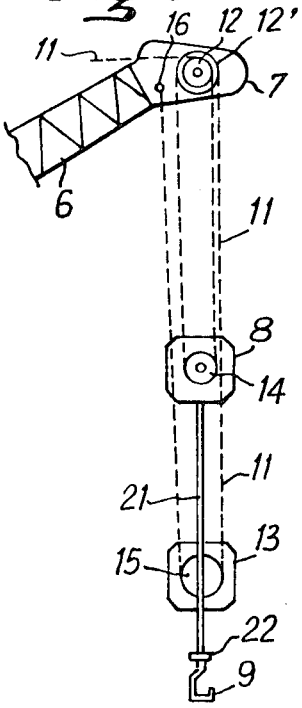

The equipment unit of FIG. 6 differs from that of FIG. 5 only in the arrangement of the cable 11 which passes successively over the pulleys 12, 14, 12' and 15 before being anchored at 16.

Figure 7:
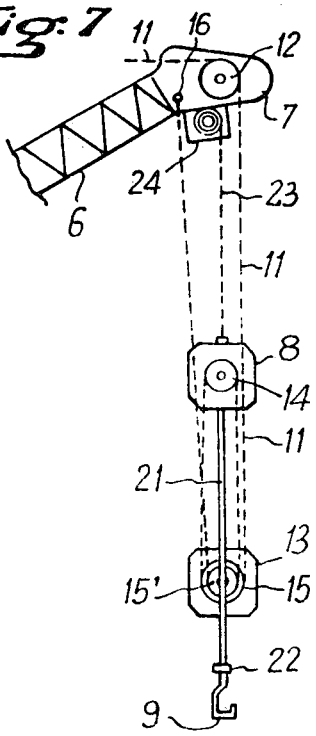

In the alternative embodiment of FIG. 7, the cable 11 passes successively over the pulleys 12, 15 and 14, then over an additional pulley 15' of the oscillating pulley-block 13 before being anchored to the head 7 at 16, if necessary after at least one passage over another similar set of pulleys. The hoisting pulley-block 8 is suspended from the head 7 by means of a cable 23 which is controlled by a restoring device 24 such as, for example, a spring-loaded winding drum, a clutch-type winch controlled by an auxiliary power source or any other control system and mounted on the boom head 7. The restoring force of the device 24 and the weight of the pulley-block 13 are such that, when no external tractive force is applied to the hook 9, the pulley-block 13 is in the bottom end position with respect to the pulley-block 8 or is moving towards this position and that a moderate action exerted on the hook 9 is sufficient to unwind the cable 23, thus causing the pulley-block 13 to move downwards at a lower speed than that of the pulley block 8 by reason of the mechanical advantage, that is to say an upward displacement of the pulley-block 13 with respect to the pulley-block 8.

For the downward travel towards the load to be picked up, the cable 11 is unwound whilst the pulley-block 13 remains applied against the abutment shoulder 22, the two pulley-blocks move down at the same speed and the cable 23 unwinds under the weight of the pulley-blocks. The movement of downward travel stops when the hook 9 reaches the load support in respect of the top position of this latter. At the time of the next downward movement of the load support, the retaining action of the slinger or hooking-on is sufficient to cause unwinding of the cable 23, which takes place at the same time as the movement of downward travel of the pulley-block 13 at a lower speed than that of the downward movement of the pulley-block 8. When the charge support undergoes an upward displacement, this action is discontinued, thus giving rise to winding of the cable 23 and an upward movement of the pulley-block 13 at a lower speed than that of the upward movement of the pulley-block 8. The load is picked up during an upward displacement and winding of the cable 11 causes a rapid upward movement of the pulley-block 13 until this latter comes into abutment with the pulley-block 8 which is also moving upwards together with the load support. Actual lifting of the load takes place when the speed of upward travel of both pulley-blocks exceeds the speed of upward displacement of the load support.

In order to deposit the load on its support, the cable 11 is unwound whilst the pulley-block 8, 13 are in a position of abutment. The operator takes advantage of a downward displacement of the support in order to deposit the load thereon and continues unwinding of the cable. Thus the pulley-block 8 is permitted to travel downwards with the support whilst the pulley-block 13 is permitted to leave its top end position and may reach its bottom end position in respect of the bottom position of the load support. The slinger who is stationed on the load support can easily unfasten the load and retain the hook 9 which remains at the level of the support until winding of the cable 11 has taken place.

Figure 8:
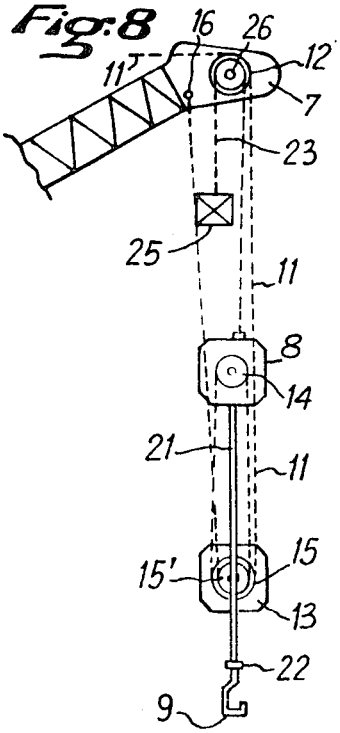

The alternative embodiment of FIG. 8 differs from the embodiment shown in FIG. 7 in that the winding drum 24 is replaced by a balance-weight 25 suspended from the cable 23 which passes over a head pulley 26. The action of the balance-weight is equivalent to that of the winding drum 24.

Figure 9:
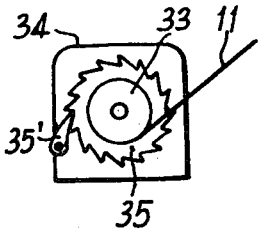
FIGS. 9 to 12 show different accessories which can be adapted to the equipment unit in accordance with the invention.

There is shown in FIG. 9 a device which can be adapted to all embodiments of the invention and facilitates lifting of the load by rapid winding of the cable 11.

Instead of being anchored to the boom head at 16, the cable 11 passes over a drum 33 which is driven by a motor 34. The drum 33 carries a ratchet wheel 35 which cooperates with a pawl 35'. The two elements just mentioned are so designed that under normal conditions, they prevent unwinding of the cable 11 of the drum 33 but allow the motor 34 to drive the drum 33 in the direction of winding of the cable. The motor 34 is actuated by the operator at the same time as the main lifting winch (winch 10 in FIG. 1) for rapid winding of the cable just before the load leaves the support. Means which are not shown in the drawings serve to make the pawl 35' inactive after a hoisting stage in order to transfer the suitable length of cable from the drum 33 to the winch 10. The same means serve to make the pawl 35' inactive as soon as the load is deposited on its support, thus permitting unwinding of the cable 11 at a sufficient speed to follow the movement of downward displacement of the load support.

Figure 10:
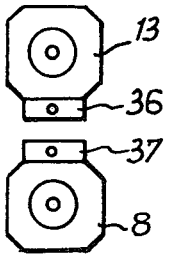

FIG. 10 shows means which can be adapted to the embodiments of FIGS. 1 to 4 for the purpose of coupling the two pulley-blocks, for example in order to utilize the equipment unit under conditions in which the aforesaid relative motion no longer exists. The two pulley-blocks carry complementary members 36, 37 which can be brought into oppositely-facing or overlapping relation and are rigidly coupled by means of a shaft, a rod, a pin, a yoke or the like (not shown in the drawings).

Figure 11:
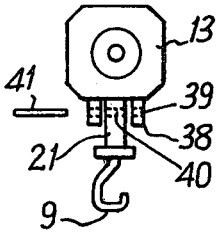

FIG. 11 shows means which can be adapted to the embodiments of FIGS. 5 to 8 for coupling the pulley-block 13 to the stem 21 or the like which carries the hook 9. The pulley-block 13 carries lugs 38 pierced by eyelets 39. The stem 21 is pierced by a hole 40 in the vicinity of that end which carries the hook 9. A pin 41 which passes through the eyelets 39 and the hole 40 serves to secure the stem 21 to the pulley-block 13.

Figure 12:
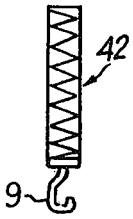

FIG. 12 shows damping means for distributing in time the force which is transmitted by the load in the event of excessively abrupt lifting of this latter. Provision is made for damping means 42 between the hook 9 and its support (stem 21 or pulley-block 8). These means can be of any suitable type (mechanical, pneumatic or hydraulic).

FIGS. 13 to 16 show different modes of coupling of the hoisting pulley-block 8 to the floating compensation pulley-block 13, which are applicable to the devices of FIGS. 1 to 8 comprising two vertically aligned pulley-blocks and which serve to define at least one of the end positions of the floating compensation pulley-block.

Figure 13:
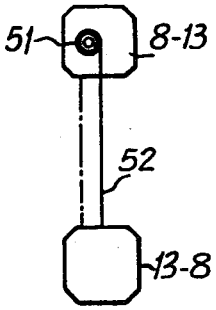
FIGS. 13 to 17 show various modes of coupling of the hoisting pulley-block and of the compensating pulley-block in the event that these latter are in vertical alignment.

In FIG. 13, one of the two pulley-blocks 8, 13 carries a spring-loaded winding drum 51, the cable 52 of which is anchored to the other pulley-block or, after passing over a return pulley of this latter, is returned to the pulley-block which carries the winding drum 51 as shown in chain-dotted lines.

Figure 14:
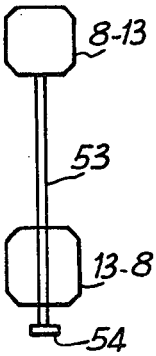

In FIG. 14, a rigid rod 53 is carried by one of the pulley blocks 8, 13, passes through the other pulley-block and the free end of said rod carries a stop 54 which defines the maximum spacing of the two pulley-blocks. The rod 53 also has a guiding function.

Figure 15:
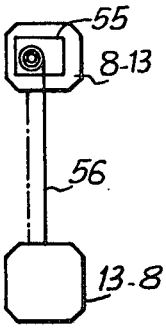

In FIG. 15, one of the pulley-blocks 8, 13 carries a winch 55, the cable 56 of which is anchored to the other pulley-block or, after passing over a return pulley of this latter, returns to the winch-carrying pulley-block as shown in chain-dotted lines.

Figure 16:
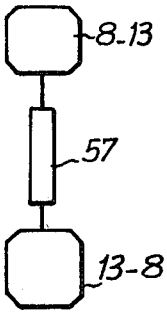

In FIG. 16, a jack 57 or the like is placed between the two pulley-blocks.

Figure 17:
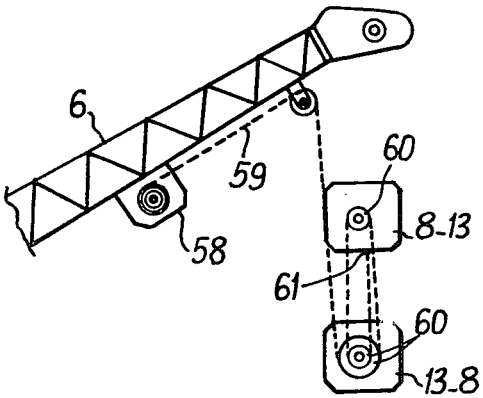

FIG. 17, in which the lifting cable has been omitted, shows an auxiliary winch 58 which is mounted on the boom 6 and the cable 59 of which passes from one pulley-block to the other and over return pulleys 60 before being anchored to one pulley-block at 61.

The sling 50 described with reference to FIG. 1 can also be placed between the two pulley-blocks 8, 13 shown in FIGS. 2 to 8.

Figure 18:
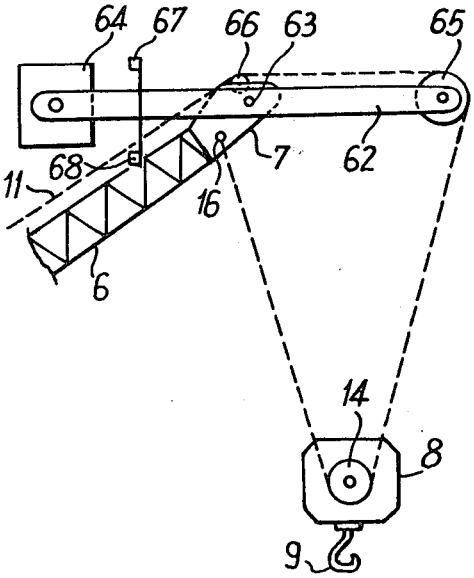
FIGS. 18 to 20 show three other alternative embodiments of the equipment unit in accordance with the invention.

In the alternative embodiment of FIG. 18, the head of the boom 6 carries an oscillating arm 62 by means of a pivot-pin 63 having a stationary horizontal axis. One end of the arm 62 carries a balance-weight 64 and the other end located beyond the pivot-pin 63 carries a guide pulley 65. After passing over a guide pulley 66 of the head 7, the lifting cable 11 passes over the pulley 65 and over the return pulley 14 of the pulley-block 8 before being anchored to the head 7 at 16. Prior to anchoring, the cable can pass at least once again over pulleys of the same type as those designated by the references 65 and 14. By way of alternative, the cable can pass successively over the pulleys 66 and 14 and be anchored to the arm 62 or to the head 7 after passing over the pulley 65. Stops 67, 68 carried by the boom 6 define the two end positions of the oscillating arm 62.

The balance-weight 64 is so arranged as to ensure that this latter is in the bottom position when no external action is exerted on the pulley-block 8 and that, when a retaining action is exerted on the hook 9 (manual action or fastening to the support 3 or to the load 4), the arm 62 is capable of oscillating between the two end positions under the action of the relative movement.

Figure 19:
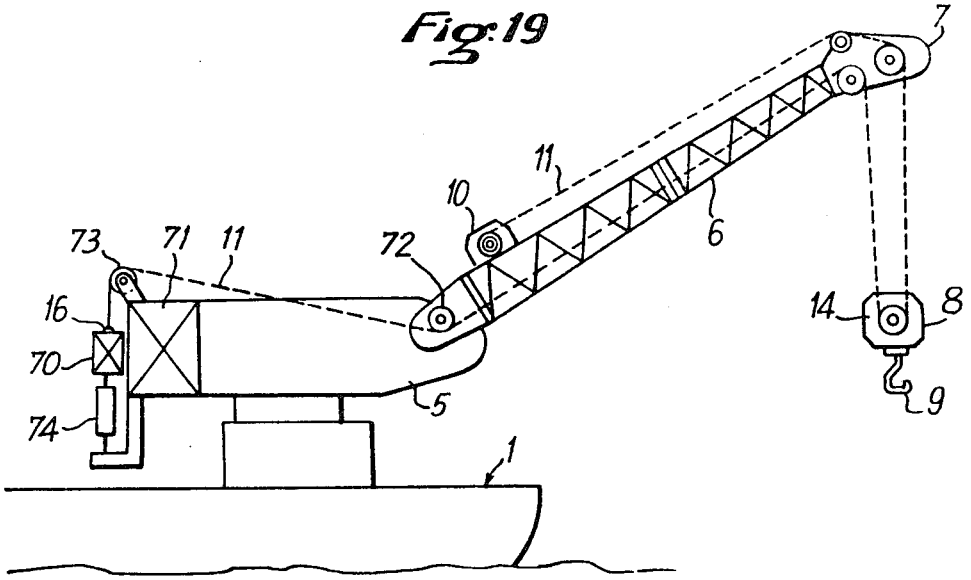

FIG. 19 shows an embodiment in which no movable return element is provided for the compensation.

In this figure, the balance-weight 70 is placed behind the turret 5 and its action is added to that of the main stationary balance-weight 71. The cable 11 passes from the hoisting winch 10, over the head 7, over the pulley 14 of the hoisting pulley-block 8, over the head 7, over a pulley 72 in coaxial relation with the shaft on which the boom 6 is pivoted to the turret 5, and over a rear pulley 73, before being attached to the pendant balance-weight 70. A jack 74 or the like which extends between the balance-weight 70 and the turret 5 defines the end positions of this latter.

In the case of large tonnages, it is possible in accordance with a distinctive feature of the invention (not illustrated in the drawings) to equip at least a certain number of pulleys with driving means controlled visually or by means of suitable detectors in order to assist the rotation of the pulleys when the main winch is stopped but when the cable 11 is displaced under the action of the relative motion between the load support and the hoisting machine.

Figure 20:
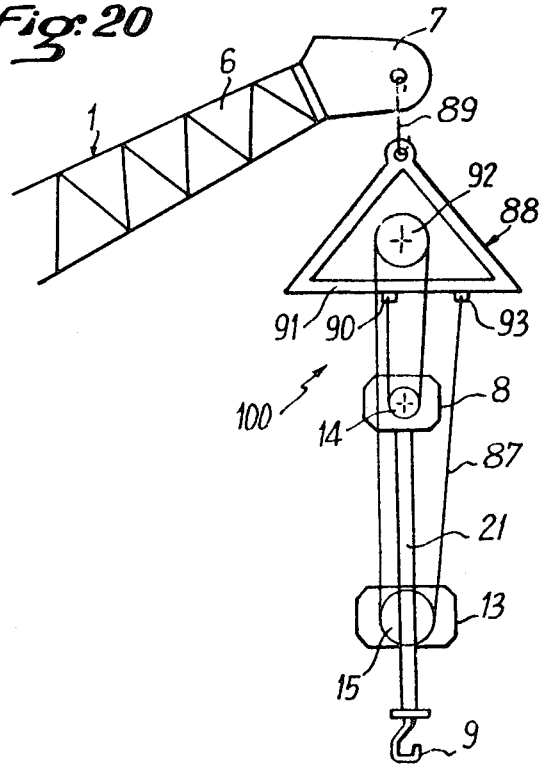

FIG. 20 shows another alternative embodiment comprising an independent equipment unit 100 which is suspended from the head 7 of the boom 6. In this case the lifting effort is obtained as a result of the pivotal movement of the boom 6.

The alternative embodiment of FIG. 20 is of the same type as the equipment unit shown in FIG. 4. The hook 9 is carried by a rod 21 which extends vertically upwards and is rigidly fixed to a hoisting pulley-block 8.

The rod 21 passes freely through a compensating pulley-block 13 which is capable of taking up a top end position in abutting contact with the pulley-block 8 and a bottom end position in abutting contact with the hook 9. The assembly consisting of the two pulley-blocks 8, 13 is suspended by means of a connecting cable 87 from a support 88 of triangular shape. An apex of the triangle serves as a point of suspension from the head 7 of the boom 6 of the hoisting machine 1 by means of a suspension element 89 which maintains the support 88 at a fixed vertical distance from the head 7.

The pulley-blocks 8, 13 are suspended in the following manner: the cable 87 is attached at 90 to the bottom horizontal cross-member 91 of the triangle, extends downwards so as to pass over a pulley 14 of the hoisting pulley-block 8, passes upwards and over a pulley 92 having a stationary axis which is loosely mounted on the support 88 within the interior of the triangle, returns downwards and passes over a pulley 15 of the compensating pulley-block 13 to be finally attached at 93 to the cross-member 91.

Should it be required to provide a hoisting tackle comprising a plurality of strands, the cable 87 is first passed successively over at least one set of pulleys of the type designated by the references 92, 14, 92 and 15 before being anchored at 93.

The compensating pulley-block 13 which forms a balance-weight is so arranged that, when no external retaining action is exerted on the hook 9, the pulley-block 13 is in the bottom position and applied against the hook 9 whilst the pulley-block 8 and the hook 9 are in the top end position and that, when the hook is pulled or retained even by hand, a movement of withdrawal of the head 7 with respect to the load or with respect to the slinger who is retaining the load enables the pulley-block 13 to move upwards. During the lifting or handling stage, the pulley-block 13 is in the top end position in which it is applied against the pulley-block 8 whilst this latter is in the bottom end position together with the hook 9.

By way of alternative to FIG. 20, the support 88 could be dispensed with, in which case the pulley 92 and the anchoring points 90 and 93 are on the head of the boom. It would also be possible to adopt the different types of arrangements described with reference to FIGS. 9 to 16.

The equipment unit shown in FIG. 20 is primarily designed for use in handling small loads.

In the embodiments described in the foregoing, the gravity-controlled restoring means were so designed as to permit displacement of the movable means between the two end positions when even a small external action was applied to the lifting hook whilst no action was exerted by the load. In these embodiments, when the load is applied to the hoisting machine, the restoring means are inactive since the action of the load is much greater than the restoring action which is in that case practically negligible.

In certain applications, and especially when it is necessary to deposit the load softly and/or accurately, it is possible in accordance with a distinctive feature of the invention to overload the restoring balance-weight in such a manner as to ensure that its action practically balances the action of the load.

By means of the arrangement just mentioned, a small external action on the load, the weight of which is practically balanced by the restoring action of the balance-weight, is sufficient to displace the load with respect to the hoisting machine. Thus, when the load is deposited on its support or is subjected to bumping action by its support (for example when the support undergoes upward displacement under the action of the waves), the load is readily displaced with respect to the hoisting machine.

In accordance with a further distinctive feature, it is also possible to provide two successive devices in accordance with the invention which are mounted in series. One device is designed to operate under no load (that is to say with a very weak restoring action) whilst the other device has a restoring action which practically balances the action of the load. The first device is employed when the load is not applied and at the time of operations which involve handling of the hook whilst the other device is employed when the load is applied.

In order to achieve this combination, the equipment unit 100 shown in FIG. 20 for example is suspended from the hook 9 of one of the embodiments shown in FIGS. 1 to 8 and 17 to 19.

As is apparent from the foregoing, the device in accordance with the invention offers many advantages and especially the following: it can readily be adapted to an existing installation without entailing substantial modifications; it is of simple design and therefore low in capital cost; it maintains the cables and the slings in continuous tension, thus avoiding the disadvantages mentioned earlier; it operates automatically without any need for supervision or control by the operator; when picking-up the load, this latter is not liable to come abruptly into contact either with its support or with the water; when depositing the load, only the hoisting winch is employed without any need to use the brake of the hoisting machine or of the auxiliary winches.

I claim:

1. A lifting and handling equipment unit comprising a powered hoisting machine for controlling lifting and handling operations between a hoisting machine support and a load support, said hoisting machine including a boom having a boom head, said load support being naturally movable with respect to said boom head in a vertical direction, said lifting equipment comprising:

a first hoisting sheave block provided with at least one first idle pulley and with a load-carrying means for carrying a load, a second floating compensation sheave block provided with at least one second idle pulley and adapted for upward and downward movements relative to said first sheave block, at least one third idle pulley vertically fixed with respect to the boom head, said first, second and third pulleys being vertically aligned, a cable reeved around said first, second and third pulleys and anchored at at least one of its ends, so that said first and second sheave blocks are freely suspended to said third pulley by said cable, said second floating compensation sheave block forming a counterweight upwardly biasing said first hoisting sheave block when substantially no downwardly directed external force is applied to said load-carrying means, stop means for limiting at least the upward movement of said second floating compensation sheave block relative to said first hoisting sheave-block when a downwardly directed external force is applied to said load-carrying means, whereby said second floating compensation sheave block is in its upper stopped position when the load is carried by the load carrying means, said second floating compensation sheave block virtually movable by gravity force with respect to said hoisting machine support, to said first hoisting sheave block and to said load support when said load carrying means and said first hoisting sheave block are maintained fixed with respect to said load support, said free vertical movement of said second floating sheave block being responsive to the vertical relative movement between said machine and load support.

2. An equipment unit as defined in claim 1, wherein said cable is an hoisting cable.

3. An equipment unit as defined in claim 1, wherein the second foating compensation sheave block is located below the first hoisting sheave block, said load carrying means being supported below said second sheave block, coupling means connected to said second sheave block at one end and to said load carrying means at its other end, said coupling means being passed through said second sheave block.

4. An equipment unit as defined in claims 1 or 3, wherein said stop means is formed by the first sheave block.

5. An equipment unit as defined in claims 1 or 3, wherein said coupling means is a rigid rod.

* * * * *